US005213892A

United States Patent [19]

Bruckner

[11] Patent Number: 5,213,892

[45] Date of Patent: May 25, 1993

[54] ANTISTATIC CORE-SHEATH FILAMENT

[75] Inventor: Werner Bruckner, Kriftel, Fed. Rep. of Germany

[73] Assignee: Hoechst Aktiengesellschaft, Fed. Rep. of Germany

[21] Appl. No.: 552,701

[22] Filed: Jul. 13, 1990

[30] Foreign Application Priority Data

Jul. 13, 1989 [DE] Fed. Rep. of Germany ..... 3923086

[51] Int. Cl.[5] ..... D02G 3/00

[52] U.S. Cl. ..... 428/372; 428/373; 428/374

[58] Field of Search ..... 428/372, 373, 374

[56] References Cited

U.S. PATENT DOCUMENTS

| | | | |
|---|---|---|---|
| 3,616,183 | 10/1971 | Brayford et al. | 161/175 |
| 3,679,541 | 7/1972 | Davis et al. | 161/175 |
| 3,803,453 | 4/1974 | Hull | 139/426 R |
| 4,473,617 | 9/1984 | Van Leeuwen | 264/171 X |
| 4,612,150 | 9/1986 | De Howitt | 264/105 X |
| 4,900,495 | 2/1990 | Lin | 264/103 |
| 5,026,603 | 6/1991 | Rodini | 428/362 |

FOREIGN PATENT DOCUMENTS

| | | | |
|---|---|---|---|
| 0343496 | 11/1989 | European Pat. Off. | 428/373 |
| 1908173 | 9/1970 | Fed. Rep. of Germany . | |
| 2337103 | 1/1975 | Fed. Rep. of Germany . | |
| 59-30912 | 2/1984 | Japan | 428/373 |
| 61-102474 | 5/1986 | Japan | 428/373 |
| 1269740 | 4/1972 | United Kingdom . | |

*Primary Examiner*—Patrick J. Ryan
*Assistant Examiner*—N. Edwards
*Attorney, Agent, or Firm*—Connolly & Hutz

[57] ABSTRACT

Antistatic synthetic bicomponent filaments of the core-sheath type have a core of increased electrical conductivity comprising a synthetic polymer in which solid, electrically conductive particles have been dispersed and a sheath of increased conductivity comprising a filament-forming polymer which contains one or more conventional antistats.

10 Claims, No Drawings

ANTISTATIC CORE-SHEATH FILAMENT

DESCRIPTION

The present invention relates to antistatic, synthetic bicomponent filaments of the core-sheath type where not only the core but also the sheath shows increased electrical conductivity.

Core-sheath filaments having an electrically conductive core are already known from DE-C-2 337 103. The conductive core of these filaments contains finely divided, electrically conducting carbon black in amounts of from 15 to 50%. The sheath of these filaments is free of dispersed carbon black and other conductivity-increasing additions and therefore is electrically non-conducting. These known filaments develop an adequate electrical conductivity only when a relatively high electric voltage is applied to them. For this reason the antistatic effect of these known filaments does not meet the high requirements for use for example in clean room clothing.

Filaments which contain dispersed carbon black over their entire cross-section are not only unattractive but also, owing to their low strength, difficult to process as textiles and also show inadequate wear properties.

DE-A-1 908 173 discloses electrically conductive polyester filaments which contain an addition of paraffin-sulfonates as antistat. This addition and hence the electrostatic effect, however, prove to be insufficiently resistant to laundering to be used for example for manufacturing clean room clothing. The experience is similar with virtually any antistatic addition, so that the addition of carbon black or other conductive particles to the fiber-forming polymer continues to produce the best antistatic effect.

There is therefore still an urgent need for synthetic filaments which show good, wash-resistant electrical conductivity and at the same time have good textile processing and wear properties.

The antistatic, synthetic bicomponent filaments according to the present invention have a considerably improved property portfolio compared with the known antistatic filaments of the core-sheath type. The antistatic, synthetic bicomponent filaments according to the present invention are those of the core-filament type where the core shows increased electrical conductivity; however, they are distinguished from existing such filaments in that their sheath also shows increased electrical conductivity.

The core and the sheath of the filaments according to the present invention contain different conductivity additions. Whereas the core consists of a synthetic polymer in which solid, electrically conductive, particles have been dispersed, the sheath consists of a filament-forming polymer which contains an addition of conventional antistats based on sulfonato- or carboxylato-containing organic compounds of low diffusivity in the polymer.

The solid, electrically conductive particles of the core material consist preferably of conductive carbon modifications or of conventional semiconductor materials.

Suitable conductive carbon modifications are conductive carbon black or graphite. The conductive carbon black used can be for example furnace black, oil furnace black or gas black acetylene black, in particular the specific, electrically superconductive grades thereof.

Particular preference is of course given to specific high conductivity blacks such as the commercial high conductivity black (®)Printex XE2 from Degussa, Frankfurt (M).

Semiconductor materials which are capable if finely divided of imparting the desired conductivity to the core material of the filaments according to the present invention are for example metal oxides which have been doped to be n- or p-conducting.

Electrically conducting materials based on metal oxides consist of mixed oxides where the crystal lattice of the main component contains a small or minor amount of an oxide component of a metal having a valence or ionic radius which differs from that of the metal of the main lattice. Examples of such mixed oxides are nickel oxide, cobalt oxide, iron oxide and manganese oxide doped with lithium oxide; zinc oxide doped with aluminum oxide; titanium oxide doped with tantalum oxide; bismuth oxide doped with barium oxide; iron oxide ($Fe_2O_3$) doped with titanium oxide; titanium-barium oxide ($BaTiO_3$) doped with lanthanum oxide or tantalum oxide; chromium-lanthanum oxide ($LaCrO_3$) or manganese-lanthanum oxide ($LaMnO_3$) doped with strontium oxide; and chromium oxide doped with manganese oxide. This list is by no means exhaustive. There are many other suitable mixed oxides, but it is also possible to use other known compounds having electrical semiconductor properties, for example those which are based on metal sulfides. A preferred solid semiconductor material which in finely divided form is capable of conferring the desired electrical conductivity on the core material of the filaments according to the present invention is for example antimony- or iodine-doped tin oxide.

The electrically conductive particles dispersed in the core of the electrically conductive filaments according to the present invention have an average particle size which for "textile" filament deniers is advantageously below 5 μm. Preferably, the conductive particles have an average particle size of below 1 μm, in particular below 0.3 μm.

The amount of conductive particles present in the core polymer depends on the conductivity requirements for the filament and on the nature of the conductivity addition.

Conductive carbon modifications are dispersed in the core of the filaments according to the present invention in an amount of 5–60% by weight, preferably 5–30% by weight, in particular 8–15% by weight, in a finely divided form.

Semiconductor materials, for example the above-mentioned ones based on doped metal oxides, are present in the core in an amount of 60–80% by weight, preferably 65–75% by weight.

The antistat present in the sheath of the filaments according to the present invention has sulfonate or carboxylate groups, i.e. salts of sulfo or carboxyl groups. The nature of the salt-forming metal is in principle of minor importance. However, preference is given to sulfonates or carboxylates formed with a monovalent or divalent metal, preferably an alkali or alkaline earth metal. Of the two salt-forming groups mentioned, the sulfonic acid group and hence the sulfonates are preferred. The sulfonato- or carboxylato-containing organic compounds should migrate as little as possible within the sheath polymer of the filaments according to the present invention. One way of minimizing the migration of these antistatic additions is to use compounds having a long-chain polyether or alkyl moiety of from 8 to 30 carbon atoms in the chain.

Particular preference is given here to compounds which contain an alkyl chain of from 8 to 30, preferably from 12 to 18, carbon atoms. Particularly preferred antistats for the sheath polymer of the filaments according to the present invention are alkanesulfonates of the above-mentioned chain lengths, in particular their sodium or potassium salts.

The polymers used for the core and the sheath of the bicomponent filaments according to the present invention can be identical or different. Having regard to the functions of core and sheath, it has proved to be advantageous to use different materials which can be optimized to the desired function Advantageously, the sheath is made of a polymer which confers on the bicomponent filament according to the present invention the desired textile property, in particular strength and processibility, while the core must guarantee the permanent electrical conductivity of the material; that is, the core must retain its continuity throughout all further processing operations on the filament and it must possess optimal carrying capacity for the dispersed solid semiconductor material. It is not essential for the core that the polymer be spinnable into filaments on its own and therefore this polymer need not be a filament-forming polymer. On the other hand, the use of filament-forming polymers for the core material is in general advantageous.

However, it has proved to be very advantageous to use for the core of the bicomponent filaments according to the present invention a polymer which has a lower melting point than the polymer of the sheath. The melting point difference should be at least 20° C., preferably at least 40° C.

In a preferred filament material according to the present invention, the polymer of the core consists of polyethylene or nylon 6 or of a copolyamide or a copolyester whose cocomponents have been selected in a conventional manner in such a way that the desired melting point difference obtains. Further suitable polymers for the core of the filaments according to the present invention are block copolymers having rigid and soft segments, e.g. block polyether-esters or other polyalkylenes, e.g. relatively low molecular weight polypropylene.

A suitably material for the sheath of the bicomponent filaments according to the present invention, which preferably determines the textile properties of the filament material, is in particular a high molecular weight polymer, in particular a polyester or polyamide. Particularly advantageous properties are possessed by bicomponent filaments according to the present invention whose sheath consists of polyesters, preferably polyethylene terephthalate.

The proportion of the volume of the whole filament according to the present invention accounted for by the core is from 2 to 50%, preferably from 5 to 20%.

The sheath of the antistatic filaments according to the present invention may, in addition to the antistat, contain customary amounts of further additives which are customary in synthetic fibers, for example delusterants or pigments.

In a preferred embodiment, the sheath cf the filaments according to the present invention contains a delusterant whereby the shining through the sheath of the core, which may be colored owing to its conductivity addition, is prevented or reduced; which is determined by the amount of delusterant chosen.

A preferred delusterant is titanium dioxide, which may ordinarily be present in the filament sheath in amounts of from 0.5 to 3% by weight.

The electrically conductive bicomponent filaments according to the present invention are produced by first producing a core material by homogeneously mixing a finely divided form or formulation, for example a powder or a user-friendly powder formulation in granule or bead form, of one of the abovementioned electrically conductive materials into a first polymer material, producing a sheath material by homogeneously mixing one of the abovementioned antistats based on a sulfonato- or carboxylato-containing organic compound with or without further customary additives into a second polymer material, which may be identical to the first polymer material, and spinning the so pretreated core and sheath materials from a conventional spinning arrangement into core-sheath filaments at a volume ratio of core to sheath material extruded per unit time of from 2:98 to 1:1.

Depending on the jet take-off speed chosen, which today depending on the equipment may in general be within the range from a few 100 m/min to about 8000 m/min, the filaments obtained differ in orientation and hence in mechanical properties, for example tensile strength, extensibility and initial modulus. At very high spin speeds the filaments as spun already have a high degree of orientation and hence good mechanical and textile properties.

Lower spin speeds produce initially less highly oriented, i.e. less strong, more extensible filaments which are drawable in a conventional manner in order that the mechanical properties required may be instilled.

The draw ratio employed here is within the range from 5% above the natural draw ratio to 95% of the maximum draw ration, preferably within the range from 3:1 to 5:1, in particular from 3:1 to 4:1.

After drawing, the filaments may, if desired, be subjected to a customary heat setting treatment, in general a shrinkage of from 0 to 8%, preferably, from 0 to 4%, being allowed during heat setting or immediately thereafter.

The drawing and heat setting temperatures are adapted to the processed fiber material in a conventional manner. Customarily, the drawing temperature is within the range from 40° to 200° C., preferably from 40° to 160° C., while the heat setting treatment is carried out within the temperature range from 100° to 240° C.

Thereafter the filaments thus produced can be further processed into textile products in any known manner. For example, the filaments can be bundled together to form continuous filament yarns and if desired be textured in a conventional manner, for example by air jet texturing, a false twist process or by a further draw-texturing operation, or the spun filaments can be subjected before or after a texturing operation to, for example, a stuffer box crimping operation and be cut into staple fibers, which are then spun into yarns. Preference is given to the further processing of the electrically conductive filaments according to the present invention into continuous filament yarns which are then converted into the desired textile products in a conventional manner. The textile products formed from the electrically conductive bicomponent filaments according to the present invention, for example continuous filament yarns in textured or nontextured form and staple fiber yarns but also intermediate forms such as filament tows or tundles and also the textile sheet materials produced from the filamentary materials, also form part of the subject-matter of the present invention.

The electrically conductive filaments according to the present invention surprisingly show good electrical conductivity even at low applied voltages, as a consequence of which only significantly smaller electrical charge buildups can result than in the case of conventional filaments having an electrically conductive core. In addition, the electrical conductivity of the filaments according to the present invention is significantly more resistant to laundering than that of known filaments which have been modified with antistats in a conventional manner The particularly advantageous conductivity characteristics of the filaments according to the present invention are complemented by excellent textile properties.

The Examples which follow illustrate the production of the electrically conductive filaments according to the present invention and demonstrate the surprising effect of the basically only slightly electrically conductive filament sheath on the antistatic effect of the filament as a whole and the very high resistance of this effect to intensive washing.

EXAMPLE 1

(Filament According to the Present Invention)

To produce the core material, 10 parts by weight of carbon black ((®)Printex XE 2 from Degussa) were incorporated at 170° C. in a kneader into 100 parts by weight of a low-viscosity polyethylene ((®)Riblene 1800 V from Enichem).

To produce the sheath material, 100 parts by weight of polyethylene terephthalate, 2 parts by weight of titanium dioxide and 2 parts by weight of sodium paraffinsulfonate ((®)Hostastat HS 1 from Hoechst AG) were mixed at 275° C. in a twin-screw extruder.

These two components were spun at 265° C. from a 32-hole jet on a bicomponent melt spinning unit into core-sheath filaments which were wound up at 700 m/min. The core accounted for 10% of the volume.

The filament was drawn over a 3-godet drawing unit, subjected to a heat treatment and wound up:

1st godet 95° C., 55 m/min

2nd godet 180° C., 181.5 m/min

3rd godet 30° C., 176 m/min

The specific resistance of the filament is listed in the table.

EXAMPLE 2

(Conductive Core, Nonconductive Sheath)

To produce the core material the procedure of Example 1 was followed.

To produce the sheath material, 100 parts by weight of polyethylene terephthalate and 2 parts by weight of titanium dioxide were mixed at 275° C. in a twin-screw extruder. No antistat was added.

These two components were used as described in Example 1 to produce a core-sheath filament.

The specific resistance of the filament is listed in the table.

EXAMPLE 3

(Monocomponent Filament with Antistatic Finish)

The antistatically finished sheath material of Example 1 was spun out on the same bicomponent unit, but no core material was added, producing a monocomponent filament which was drawn as described in Examples 1 and 2.

The specific resistance of the filament is shown in the table.

TABLE

Specific resistance of filaments pretreated by three washes with methanol, three washes with petroleum ether and a two-hour extraction with distilled water. The measurements were carried out after 24 hours' conditioning.

| | Specific resistance in megaohm.cm | |
|---|---|---|
| | 65% relative humidity | 20% relative humidity |
| Example 1 (filament according to the present invention) | 3 | 1,750 |
| Example 2 (conductive core, nonconductive sheath) | 2,800 | 35,000 |
| Example 3 (antistatically finished monocomponent filament) | 70,000 | 105,000 |

I claim:

1. An antistatic synthetic bicomponent filament of the core-sheath type with an electrically conductive cores and an electrically conductive sheath, the core comprising a synthetic polymer in which solid, electrically conductive particles are dispersed, and the sheath comprising a filament-forming polymer containing one or more conventional antistats based on sulfonato-or carboxylato-containing organic compounds of low diffusivity, and wherein from 5 to 60% by weight of conductive carbon or from 60 to 80% by weight of semiconductor materials are finely dispersed in the core.

2. The bicomponent filament as claimed in claim 1, wherein the solid conductive particles of the core material consist of conductive carbon or of semiconductor materials.

3. The bicomponent filament as claimed in claim 1, wherein the solid conductive particles of the core material consist of highly conductive carbon black or of antimony- or iodine-doped tin oxide.

4. The bicomponent filament as claimed in claim 1, wherein the antistat of the sheath is the metal salt of a sulfonic or carboxylic acid with a long-chain aliphatic moiety.

5. The bicomponent filament as claimed in claim 1, wherein the antistat of the sheath is a metal salt of an alkanesulfonic acid of from 8 to 30 carbon atoms.

6. The bicomponent filament as claimed in claim 1, wherein the antistat of the sheath is a metal salt of sodium or potassium.

7. The bicomponent filament as claimed in claim 1, wherein the polymer of the core has a lower melting point than that of the sheath.

8. The bicomponent filament as claimed in claim 1, wherein the polymer of the core is polyethylene or a block polyether-ester.

9. The bicomponent filament as claimed in claim 1, wherein the polymer of the sheath is a polyamide or a polyester.

10. A sheet-like filamentary material comprising the antistatic synthetic bicomponent filament defined in claim 1.

* * * * *